US006749472B1

(12) United States Patent
Chen-Lieh

(10) Patent No.: US 6,749,472 B1
(45) Date of Patent: Jun. 15, 2004

(54) SWIMMING FIN

(75) Inventor: Pan Chen-Lieh, Ilan Hsing (TW)

(73) Assignee: QDS Injection Molding LLC, San Diego, CA (US)

( * ) Notice: Subject to any disclaimer, the term of this patent is extended or adjusted under 35 U.S.C. 154(b) by 0 days.

(21) Appl. No.: 10/304,754

(22) Filed: Nov. 27, 2002

(51) Int. Cl.[7] ..... A63B 31/08
(52) U.S. Cl. ..... 441/64
(58) Field of Search ..... 441/61, 62, 63, 441/64

(56) References Cited

U.S. PATENT DOCUMENTS 3,082,442 A * 3/1963 Cousteau et al. ..... 441/64
5,163,859 A * 11/1992 Beltrani et al. ..... 441/64
6,224,443 B1 * 5/2001 Mehrmann et al. ..... 441/64
6,568,973 B2 * 5/2003 Testa ..... 441/64
6,568,974 B2 * 5/2003 Semeia ..... 441/64

* cited by examiner

*Primary Examiner*—S. Joseph Morano
*Assistant Examiner*—Lars A. Olson
(74) *Attorney, Agent, or Firm*—Troxell Law Office PLLC

(57) ABSTRACT

A swimming fin includes a foot pack and a blade. The foot pack has a space therein for being inserted with a sole of a wearer. The blade extends from the foot pack with a flat shape. It is characterized in that a root, which is disposed at an intersection of the foot pack and the blade, is formed by way of alternate arrangement of at lest a hard coil and at least a soft coil.

3 Claims, 4 Drawing Sheets

SWIMMING FIN

FIELD OF THE INVENTION

The present invention relates to a swimming fin and particularly to an improvement of the conventional swimming fin, with which the foot pack and the blade thereof are designed to join to each other as a structure capable of saving effort exerted by the wearer.

BACKGROUND OF THE INVENTION

The swimming fin is one of indispensable facilities for the aquatics, especially the bed exercise. The principle of operating the swimming fin is that the wearer puts on the swimming fin with each foot respectively and a blade at the rear end of the swimming fin swings up and down to act on the water stream.

Accordingly, the structure of the swimming fin can be roughly divided into two parts, a foot pack being put on by a foot of the wearer and a water-bearing blade. The foot pack as the ordinary shoe is designed to have different sizes to comply with different soles in size. Basically, the size of a foot pack relates comfort of the wearer but it is no much relation with the forward force. The blade swinging up and down concerns the forward movement of the wearer so that the soft and flexible material is used for the blade. The blade is designed mostly in accordance with a shape of the tail fin of an ocean fish such as a whale or a stingray such that how to transmit the foot movement done by the wearer to the blade and to actuate smoothly with less effort is a key point pursued by the designer.

It is known by the experienced wearer that movements of a swimming fin include a down kick and an up kick. The down kick is a movement, which is to press water, for generating a forward moving force so that it is necessary to press downward with a full force. Considering the foot of the wearer bearing the force upward, the up kick force can be smaller so that the up kick is not required to produce a push force like the down kick. That is, the push force produced during up kick is about 60~70% of the push force during down kick.

The conventional swimming fin sold in the market is seldom to utilize the entire water-bearing cross section of the blade so that it needs great effort exerted by the user but it is unable to obtain a push force equivalent to the great effort. Alternatively, a blade with a greater area is the only way to do in order to obtain a greater push force while in use. Thus, a greater force has to be exerted by the user naturally.

U.S. Pat. Nos. 4,795,385, 5,304,081 and 6,159,064 are prior references, which are aimed to improve the design of the swimming fin and obtain more or less effects advantageously.

SUMMARY OF THE INVENTION

The crux of the present invention is to provide a swimming fin, which includes a foot pack and a blade. The foot pack has a space therein for being inserted with a sole of a wearer. The blade extends from the foot pack with a flat shape. It is characterized in that a root, which is disposed at an intersection of the foot pack and the blade, is formed by way of alternate arrangement of at lest a hard coil and at least a soft coil.

BRIEF DESCRIPTION OF THE DRAWINGS

The present invention can be more fully understood by reference to the following description and accompanying drawings, in which.

DETAILED DESCRIPTION OF THE PREFERRED EMBODIMENT

Basically, it is known that the hard material has a worse flexibility so that the hard material at an end thereof provides a less swing breadth in case of the other end thereof being subjected to a force. Although the soft material has a better flexibility, the strength is weak and it has to be increased the size thereof in order to intensify the rigidity thereof.

Accordingly, the improvement of the present invention is in that the intersection of the foot pack and the blade, i.e., the root of the blade is made with the soft material integrated with the hard material.

Figure 1:
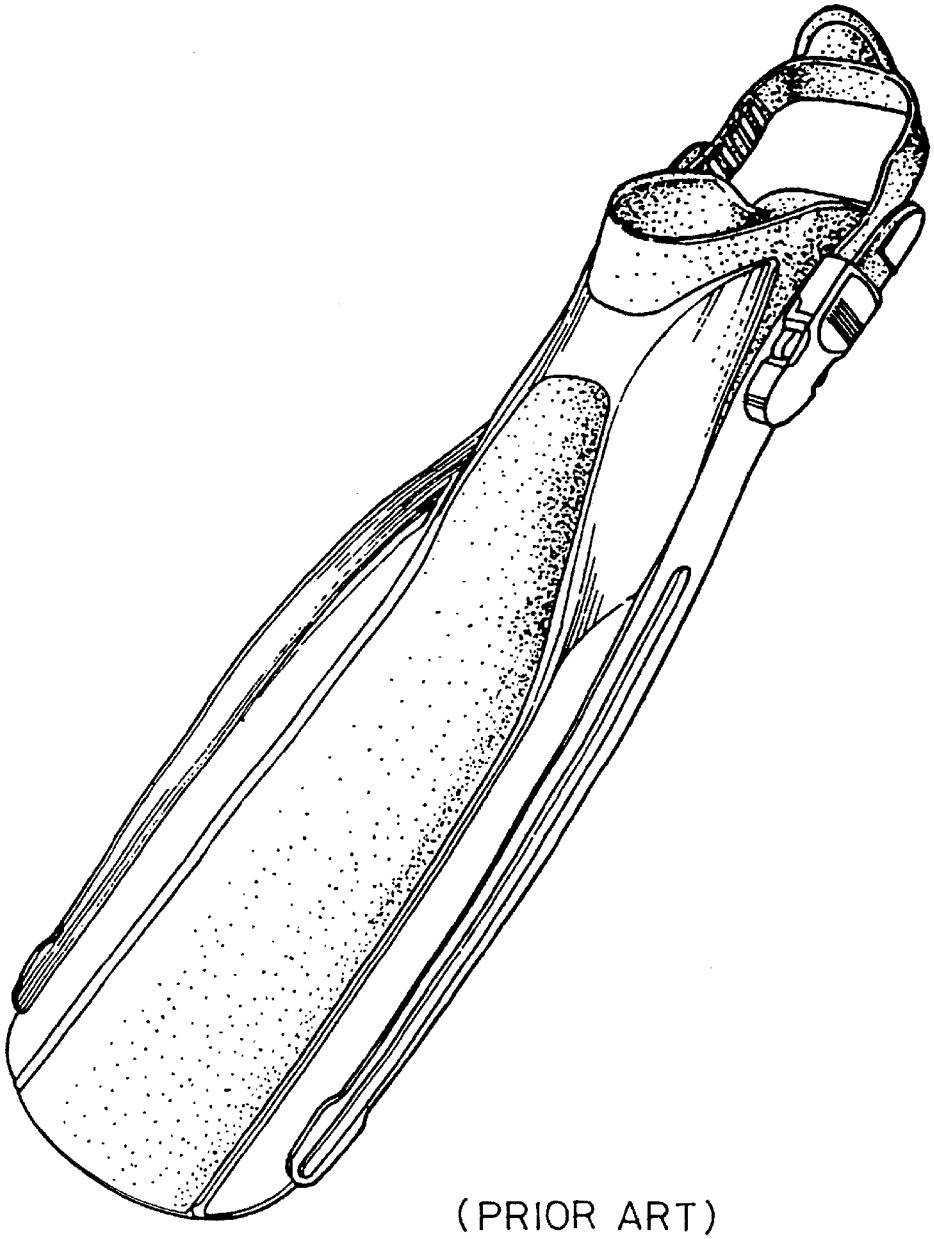
(PRIOR ART) FIG. 1
FIG. 1 is a perspective view of a conventional swimming fin.
Figure 2:
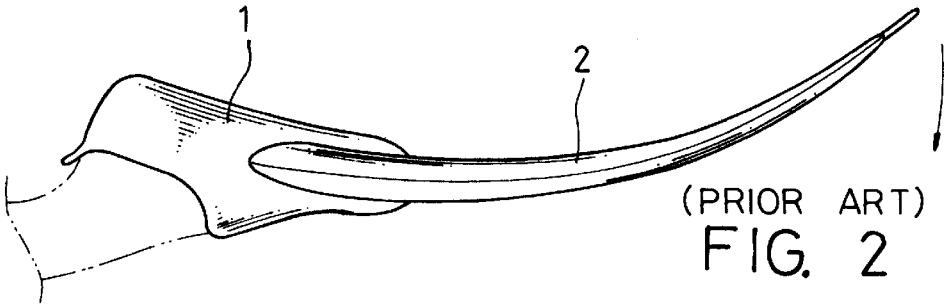
(PRIOR ART) FIG. 2
FIG. 2 is a plan view of a swimming fin illustrating the blade thereof performing a motion of down kick.
Figure 3:
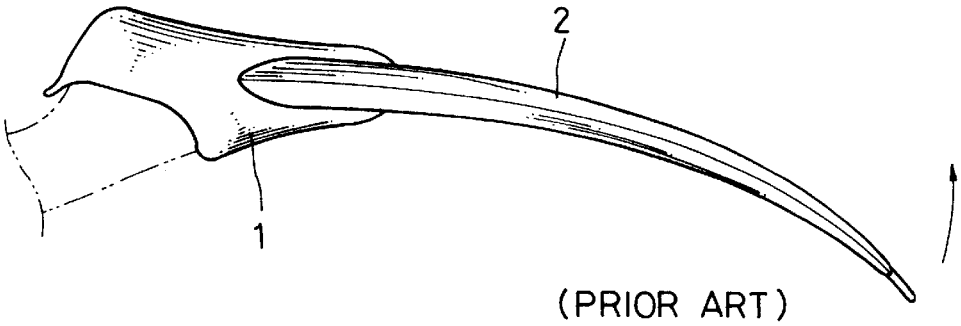
(PRIOR ART) FIG. 3
FIG. 3 is a plan view of a swimming fin illustrating the blade thereof performing a motion of up kick.
Figure 4:
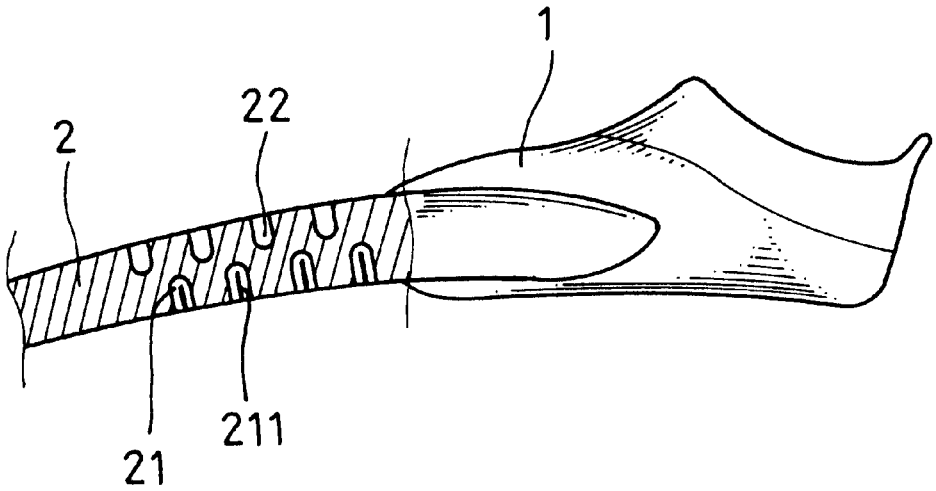
FIG. 4 is a sectional view of a swimming fin of the present invention.

Referring to FIG. 4, the swimming fin of the present invention is composed of a foot pack 1 and a blade 2.

Wherein, the foot pack 1 is provided for being inserted with a sole of the wearer and it is made in different sizes for variable foot sizes. A tying band or a lock part can be added to enforce the firmness between the foot and the swimming fin. This is belonged to the prior art so that no detail will be described further.

The blade 2 integrally extends from the foot pack 1 and the tail end thereof can be arranged to have an enlarged area for increasing the water-bearing plane. It is noted that the enlarged tail end is an embodiment and not a limitation. The blade 2 is made of harder material.

The swimming fin of the present invention is different from the prior art in that the intersection of the blade 2 and the foot pack 1 or the root of the blade 2 are made by way of the soft material and the hard material being formed in a way of alternating coils, which are at least a soft coil 21 and a hard coil 22. Hence, the blade root is provided with resilience as the spring does.

The soft coil 21 can be made of soft material such as thermoplastic rubber (TPR), which is good in resilience and elongation. The hard coil 22 is made of a material such as nylon (EVA), PP or any other hard high molecular material, which is harder than the soft coil 21.

Referring to FIG. 4 again, the exertion end is originated from the root of the blade 2 regardless the blade 2 being kicked up or kicked down while in use. The soft coil 21 leads to that the blade 2 is more flexible and resilient and a smoother return for the amplitude can be obtained while the blade 2 is shook. That is, the alternate time corresponding to the alternate movements resulting from up kicks and down kicks can be prolonged due to the flexibility of the soft coil 21 so that the swing can reach a farther retracing point before turning back. Hence, the exertion force of the wearer can be worked preferably.

Figure 5:
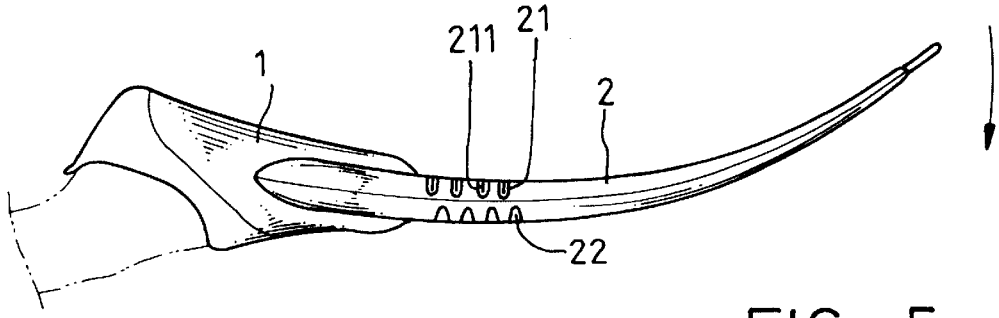
FIG. 5 is a plan view of the swimming fin according to the present invention illustrating a state of the soft coils with split clearances thereof during the swimming fin being kicked downward.
Figure 6:
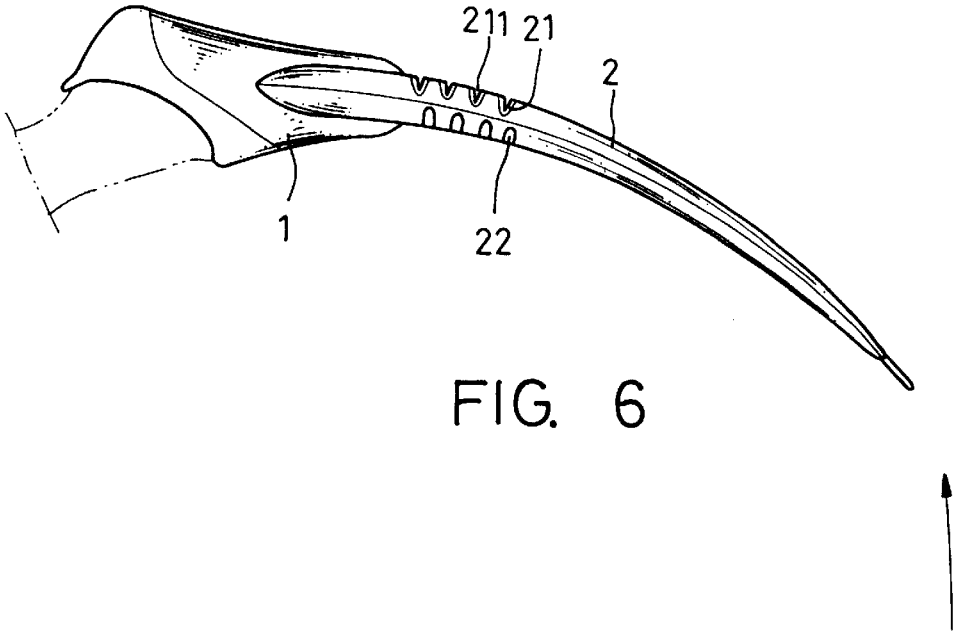
FIG. 6 is a plan view of the swimming fin according to the present invention illustrating a state of the soft coils with split clearances thereof during the swimming fin being kicked upward.

Besides, referring to FIGS. 5 and 6, in order to actuate the blade 2 smoothly during exerting the foot force, the soft coil 21 is provided with a split clearance 211 and the split clearance 211 can open during the blade 2 being stretched. FIG. 5 illustrates the split clearance 211 is in a state of closing while the swimming fin is kicked and the blade presses downward. FIG. 6 illustrates the blade 2 swings downward to open the split clearance 211 while the swimming fin is kicked up. The split clearance 211 retracts gradually from opening while the swimming fin is made a turn so that the turn of the blade 2, which is between the up kick and the down kick, can obtain a cushion and become softer and smoother with a gentler swing breadth than the prior art.

It is appreciated that the swimming fin of the present invention has the following advantages:

(1) The swing breadth of the blade thereof is increased effectively so as to obtain a greater push under the same force exerted by the wearer.

(2) The blade is provided with soft coils for the retracing point being capable of falling at a spot where the kinetic energy thereof is exhausted so that it is possible to free from the trouble caused by the containing inversed force done in the prior art. Meanwhile, the swing breadth is pretty smooth.

(3) The cost to fabricate the swimming fin of the present invention can be reduced substantially. Although the single soft material such as DOUPRENE design adopted in the conventional swimming fin can provide sufficient flexibility, it is extremely expensive with the unit price being between US $5.0 and US $5.8 per kilogram. Further, the root of the blade 2 has to be increased the outer diameter thereof. If the swimming fin of the present invention is fabricated with EVA material, the unit price thereof is US $1.0 to US $1.5 per kilogram. Even the ordinary TRP is used, the unit price of the material is between US $2.8 and US $4.3, which are lower than the specific material.

Furthermore, it has to be mentioned that the preceding soft coil 21 and the hard coil 22 between the foot pack 1 and the blade 2 can be made as strips, lumps, being continuous or being discontinuous.

While the invention has been described with reference to the a preferred embodiment thereof, it is to be understood that modifications or variations may be easily made without departing from the spirit of this invention, which is defined by the appended claims.

What is claimed is:

1. A swimming fin comprising:

a) a foot pack having a space for inserting a sole of a wearer;

b) a blade connected to and extending from the foot pack, the blade having a flat shape and a root section located on an end of the blade connected to the foot pack;

c) a plurality of soft coils located in the root section, each of the plurality of soft coils including an inward split with a clearance located on an exterior side thereof; and d) a plurality of hard coils located in the root section, the plurality of soft coils and the plurality of hard coils being spaced apart and alternately arranged on opposite sides of the root section of the blade.

2. The swimming fin according to claim 1, wherein the plurality of hard coils are made of a material selected from the group consisting of ethylene vinyl acetate and polypropylene.

3. The swimming fin according to claim 1, wherein the plurality of soft coils are made of a thermoplastic rubber.

* * * * *